US007743499B2

(12) United States Patent
Pettit et al.

(10) Patent No.: US 7,743,499 B2
(45) Date of Patent: Jun. 29, 2010

(54) REACTOR MANUFACTURING METHOD FOR A FUEL CELL PROCESSOR

(75) Inventors: William H Pettit, Rochester, NY (US); Gerald E Voecks, La Crescenta, CA (US)

(73) Assignee: GM Global Technology Operations, Inc.

( * ) Notice: Subject to any disclaimer, the term of this patent is extended or adjusted under 35 U.S.C. 154(b) by 1480 days.

(21) Appl. No.: 11/019,036

(22) Filed: Dec. 20, 2004

(65) Prior Publication Data

US 2006/0130327 A1 Jun. 22, 2006

(51) Int. Cl.
*B21D 51/16* (2006.01)

(52) U.S. Cl. ..... 29/890; 29/527.1; 29/527.2; 228/165; 228/181; 422/180; 502/101; 502/439

(58) Field of Classification Search ..... 29/890, 29/527.2, 527.1; 585/709; 424/424; 422/177, 422/173, 174, 180; 502/326, 101, 439; 228/165, 228/181, 233.2; 219/117.1
See application file for complete search history.

(56) References Cited

U.S. PATENT DOCUMENTS

| | | | | | |
|---|---|---|---|---|---|
| 4,567,630 | A * | 2/1986 | Ishida et al. | ..... | 29/6.2 |
| 4,847,966 | A * | 7/1989 | Kuchelmeister | ..... | 29/890 |
| 5,394,610 | A * | 3/1995 | Stoephasius et al. | ..... | 29/890 |
| 5,406,704 | A * | 4/1995 | Retallick | ..... | 29/890 |
| 5,436,216 | A * | 7/1995 | Toyao et al. | ..... | 502/439 |
| 5,437,099 | A * | 8/1995 | Retallick et al. | ..... | 29/890 |
| 5,516,383 | A * | 5/1996 | Jha et al. | ..... | 148/531 |
| 5,628,928 | A * | 5/1997 | Rolf | ..... | 219/488 |
| 5,657,923 | A * | 8/1997 | Sheller | ..... | 228/181 |
| 5,791,044 | A * | 8/1998 | Whittenberger et al. | ..... | 29/890 |
| 5,852,274 | A * | 12/1998 | Watanabe et al. | ..... | 219/117.1 |
| 5,985,220 | A * | 11/1999 | Hughes | ..... | 422/177 |
| 6,329,139 | B1 * | 12/2001 | Nova et al. | ..... | 506/30 |
| 7,141,812 | B2 * | 11/2006 | Appleby et al. | ..... | 250/505.1 |
| 7,223,373 | B2 * | 5/2007 | Maude | ..... | 422/190 |
| 7,235,218 | B2 * | 6/2007 | Bowe | ..... | 422/211 |
| 7,300,635 | B2 * | 11/2007 | Bowe et al. | ..... | 422/190 |
| 2003/0083196 | A1 * | 5/2003 | Korotkikh et al. | ..... | 502/326 |
| 2003/0235272 | A1 * | 12/2003 | Appleby et al. | ..... | 378/147 |
| 2005/0042151 | A1 * | 2/2005 | Alward et al. | ..... | 422/177 |
| 2006/0130327 | A1 * | 6/2006 | Pettit et al. | ..... | 29/890 |
| 2007/0207186 | A1 * | 9/2007 | Scanlon et al. | ..... | 424/424 |
| 2008/0073600 | A1 * | 3/2008 | Appleby et al. | ..... | 250/505.1 |

* cited by examiner

*Primary Examiner*—Rick K Chang
(74) *Attorney, Agent, or Firm*—Harness, Dickey & Pierce, P.L.C.

(57) ABSTRACT

A method to produce a catalytic bed is initiated by forming apertures in a predetermined pattern on a strip or segment of thin foil. A pattern of desired channels is formed into the apertured foil, for example, as a herringbone pattern. The patterned foil is heat treated, and the surfaces of the foil are provided with at least one washcoat and at least one catalyzed coat, and cured. Cured foil in strip form is rolled into a multi-layer coil, or cured foil in segment form is stacked in multiple segment layers, to produce a desired geometric shape of the catalytic bed. The channels between layers of foil are offset in each successive layer to preclude channel nesting. The offset channels and apertures provide turbulent longitudinal and radial flow of a desired material throughout the catalytic bed.

10 Claims, 6 Drawing Sheets

FIG 5
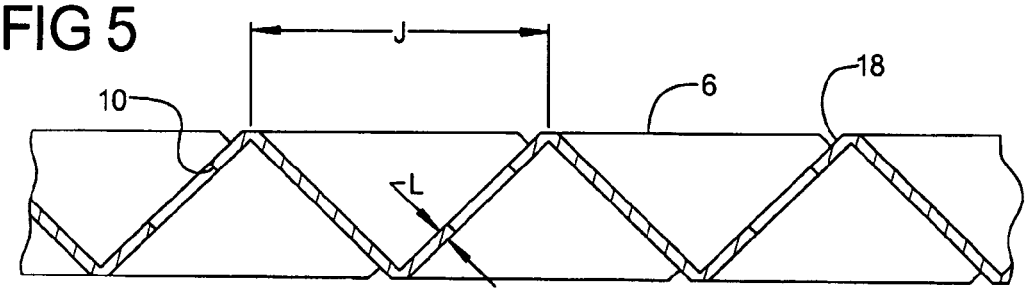
FIG 6
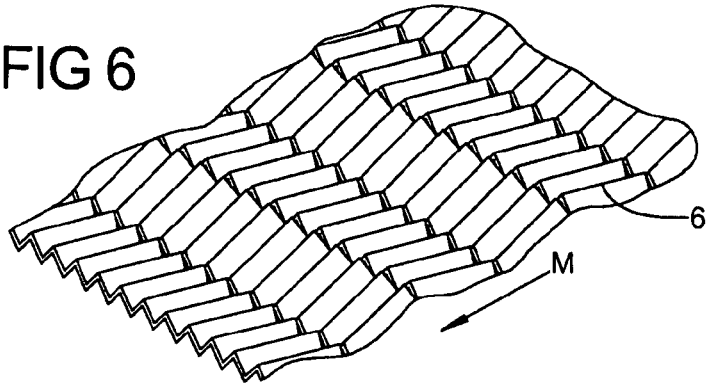
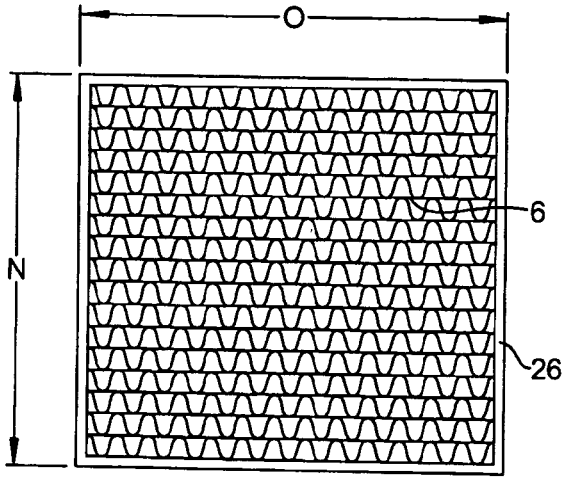
FIG 7

REACTOR MANUFACTURING METHOD FOR A FUEL CELL PROCESSOR

FIELD OF THE INVENTION

The present invention relates to a catalytic reactor for a fuel cell system, and more specifically to a method for manufacturing a catalytic reactor having a perforated metal support providing uniform wash coat catalyst loading and distribution, and turbulent flow throughout the reactor.

BACKGROUND OF THE INVENTION

Operating conditions of a catalyst system in an exemplary industrial process catalytic reactor cover a relatively small range of variables. The flow ranges in an exemplary industrial process are no more than 4 or 5:1, the inlet flow and mixing conditions are well defined, and the reaction zones are also closely controlled to produce temperature profiles that are maintained within a narrow range. Start conditions are carefully controlled to assure the catalyst and reactor are performing according to prescribed conditions. This type of operation leads to catalyst system designs that have less demanding requirements compared to operations of similar processes where temperature and performance controls must be held tightly over a wide range of dynamic operating conditions.

One of the most familiar deviations from the exemplary industrial process reactor is the automotive exhaust emission control catalyst system. In this system, the start and operating conditions are significantly different. Temperature difference and reactant ratio from start to operating conditions can vary rapidly. This catalyst system also operates with wide ranges of throughput, which can vary as much as 50:1, with space velocities in excess of 100,000 $hr^{-1}$, and high heat release (significantly higher than the exhaust emission converter) over the operating range. Because of their application, catalytic reactors must be compact as well. This demands the development of creatively designed catalyst systems that can be prepared by methods commercially conceivable.

One commercially available approach for exhaust emission control catalysts employs honeycomb monoliths for the reactor. In the operation of honeycomb monolith catalytic reactors on vehicles, thermal profile and conversion are maintained over the wide engine operating conditions, without raising system back pressure, by combining the catalyst bed structure variables, associated with the honeycomb monolith, with catalyst preparation procedures. By increasing the honeycomb cell or channel density, i.e., decreasing the cell size and reducing the wall thickness, the fluid dynamics of the reactant gases and reactions taking place over the entire operating range are improved over larger cell sizes, thus helping to maintain reasonably well-controlled temperature profiles and subsequently providing better durability.

Through the use of honeycomb monolith catalyst systems, catalyst type and loading over the length of the catalyst/converter flow path can offer reaction and temperature profile control, while simultaneously meeting the conversion required via catalyst loading and control of material availability during catalyst preparation. Improved catalyst materials, preparation procedures, and structure were developed concurrently with refinement of the catalyst structure in achieving this higher performance.

Drawbacks exist, however, for honeycomb monolith catalyst systems in fuel cell fuel processor system applications. The heat flux (heat release rate and quantity) and the relative ratio of size to degree of reaction complexity associated with an automobile exhaust catalytic reactor are relatively small compared to the primary reactor of a fuel cell fuel processor. Also, automobile honeycomb monolith exhaust catalytic reactors often detrimentally develop laminar flow through large sections of the straight, continuous, channels of their honeycomb structure. This creates mass transport problems, and the only effective means for distributing heat is axially, along the length of the channels. If any over-temperature condition develops in the inlet section, where turbulence does exist, or if any blockage or unequal distribution of inlet feed exists, there is no means by which the reactants can migrate from one channel to another in a single monolith, or redistribute the reactant flow some distance downstream from a blockage.

Modification of the honeycomb monolith assembly provides some improvement. By providing many "slices" of a honeycomb monolith, wherein the channel alignment of each slice is offset, conditions closer to continuous mixing and redistribution phenomena take place. This approach also has drawbacks, however, in that washcoating and catalyst loading are performed after assembly, which can result in non-uniform washcoating and catalyst loading throughout the offset monolith. After-assembly washcoat and catalyst loading is both extremely difficult and cost ineffective to both prepare and subsequently to retain the catalyst structure without physical damage to the washcoat or catalyst layer(s).

Another catalyst structure that has been considered for automotive and fuel processor applications is the foam support. This structure potentially provides the desired tortuous flow path that can assist in maintaining turbulent mixing of the reactants through the catalyst bed, thereby enhancing mass and heat transport properties. The disadvantage of this support structure is similar to the "sliced honeycomb monolith" in that washcoating and catalyzing the surfaces requires forcing a slurry of the washcoat and/or catalyst material through its webbed structure after assembly. Washcoating these supports uniformly throughout the structure can be very problematic, particularly when cell density is relatively high. In addition, these supports have been found to be very non-uniform in both cell size and cell distribution. This results in areas where blockages occur because of fabrication faults, making coating and distribution activity less controlled. A further disadvantage is that backpressure through these monoliths is higher than for the honeycomb monoliths.

Based on the above, there is a need for tailored catalyst systems that meet the desired activity of a fuel cell fuel processor (reactor) over a wide range of operating conditions. Catalyst system requirements for an onboard hydrocarbon (i.e., gasoline, LPG or NG) conversion processor have both similarities and significant differences from the previously mentioned examples. Similarities include: 1) the choice of catalyst and catalyst loading must be commensurate with the reaction processes and cost requirements; and 2) heat transfer and control of temperature are critical to maintaining life and conversion selectivity.

An optimal catalyst system design for fuel processor operation should provide a variety of flow paths throughout the length of the catalytic reactor, in order to induce turbulent flow to accommodate the reaction flux over the entire set of operating conditions, without compromising (1) the catalyst loading or type, (2) life of either the catalyst or reactor, (3) pressure drop, or (4) performance, i.e., conversion/selectivity. Uniformly controllable washcoat and catalyst loading is not available with the honeycomb or foam support design catalytic beds. A catalyst manufacturing method is therefore required which also incorporates controlled, but passively variable flow paths throughout the catalyst bed to promote turbulent flow throughout, the ability to control washcoat and catalyst loading prior to assembly of the bed, and an assembly which permits either the washcoat or the catalyst or both washcoat and catalyst to be varied through the catalytic bed.

SUMMARY OF THE INVENTION

To overcome the drawbacks and disadvantages of the above design approaches, and to meet the necessary design conditions noted, disclosed herein is a method of forming a catalyst bed. The method provides a metal support comprising a metal foil perforated with a plurality of apertures or holes of different sizes and shapes integrated throughout the foil. The perforated foil is then heat treated, washcoated, catalyzed and cured. The bed is assembled by either layering individual segments of the perforated, washcoated and catalyzed foil or spirally rolling a predetermined length of prepared foil strip. By combining shaped sections, in either segments or a rolled coil, with a plurality of apertures, a uniform longitudinal and radial flow path is provided throughout the bed, thus providing for controlled temperature and reaction rate throughout the bed.

The invention method provides catalyst beds possessing the necessary properties to permit successful operation of a fuel cell fuel processor over a wide range of variable conditions. Several embodiments of the invention are disclosed, each incorporating at least one of two aspects associated with catalyst fabrication. In one aspect of the invention, the catalyst system is based on forming metal foil which is replete, to the extent and need required, with apertures (holes) of size and pattern concomitant with the catalyst system design operating requirements. The perforated metal foil is then shaped into any of various configurations, such as chevrons, herringbones, waves, "Quonset huts", dimples, etc. The above features, as well as the frequency, pitch, depth, and pattern of the foil configuration are controlled to provide either multiple segments or windings of a roll, neither of which permit direct overlapping of these features that would allow "nesting", or collapsing of one segment or rolled layer onto another. Uniform flow paths throughout the catalytic bed are therefore provided in this aspect of the invention.

In another aspect of the invention, the washcoat and catalyst are applied onto the segments or strips of the metal foil catalyst support. Based on the use of segments which are later stacked, or strips which are later coiled, the washcoat and catalyst application procedure can advantageously utilize various known methods of applying the washcoat and catalyst prior to assembly of the catalytic bed. Known methods such as spraying, dipping, or growing the washcoat on the surface of the metal can then be used. The catalyst is applied as is known in the art as an individual coat after the washcoat, or is combined and applied together with the washcoat.

Application of the washcoat and catalyst at this stage eliminates the need to use the "slurry" system of washcoating and catalyzing the catalyst bed after assembly of the bed, which is required by the honeycomb and foam support designs. A different washcoat or catalyst can be applied to different layers of foil, or on different areas of a single layer, or the catalyst volume can be varied throughout. Following the washcoat and catalyst application, the coated metal is cured, preferably before but also optionally after assembly into the catalytic bed. The ability to grade the catalyst throughout the bed, provide different catalysts in different segments of the bed, or modify the washcoat type and thickness throughout the bed is therefore provided in this aspect of the invention.

In one preferred embodiment of the invention, a method to manufacture a catalytic bed is provided, comprising the steps of: providing a metal foil; disposing a desired aperture pattern in the metal foil; processing the metal foil having the desired aperture pattern into a desired foil pattern; heat-treating the desired foil pattern for a washcoat; coating the heat-treated foil pattern with the washcoat and a catalyst; and forming a geometric configuration of the catalytic bed from the coated foil pattern.

In another preferred embodiment of the invention, a method is provided to manufacture a catalytic bed for an automobile fuel processor comprising the steps of: providing a metal foil; disposing a desired aperture pattern in the metal foil having a plurality of both aperture shapes and sizes; processing the metal foil having the desired aperture pattern into a desired foil pattern; heat-treating the desired foil pattern for a washcoat; coating the heat-treated foil pattern with at least one washcoat and at least one catalyst; applying the catalyst over preselected areas of the coated foil pattern in a graded formation; forming a geometric configuration of the catalytic bed having at least two layers of the coated foil pattern; and positioning each layer of the catalytic bed to provide a non-overlapping aperture configuration.

In yet another preferred embodiment of the invention, a method is provided to provide turbulent flow in all regions of a catalytic bed comprising the steps of: providing a metal foil; disposing a desired aperture pattern in the metal foil; processing the metal foil having the desired aperture pattern into a desired foil pattern; heat treating the desired foil pattern; coating the heat-treated foil pattern with at least one washcoat and at least one catalyst; forming a geometric configuration having successive layers of the coated foil pattern; locating each of the successive layers to offset the aperture pattern between any layer and a next successive layer; and combining the successive layers to provide a network of flowpaths providing for a turbulent flow of a desired material throughout the catalytic bed in both an axial direction and a radial direction.

In still another preferred embodiment of the present invention, a catalytic bed for a fuel processor is provided, comprising: a metal foil; a preselected set of apertures being formed in said foil; said apertured foil being configured into a desired foil pattern; said foil pattern having at least one heat treated surface; each heat treated surface having at least one washcoat and at least one catalyst coat; a plurality of said washcoated and catalyst coated foil surfaces being formed into a geometric pattern having a plurality of adjacent layers; and the foil pattern of each layer has a foil pattern mismatch to each adjacent layer foil pattern to preclude foil pattern nesting between adjacent layers.

Because the invention provides for strips or sheets that can be assembled in a variety of configurations, such as layers of sheet segments or rolls of foil, the catalyst and washcoat applications can incorporate various compositions and formulations that can be installed into the assembly of a catalyst bed. Assembly of the catalyst bed can utilize any of numerous choices including: (1) layering of sheet segments that are each differently catalyzed; (2) layering of sheet segments that are graded with different catalyst/washcoat over two dimensions of the foil; or (3) rolling separate strips which are selectively adjoining each other over the centerline length of the bed, with differing aperture designs and catalyst/washcoats to provide a desired flow and activity profile for control of a reaction.

Combining the perforated metal having desired designs for flow distribution with subsequent catalyst preparation provides for catalyst bed flow patterns that can be modulated over the catalyst bed dimensions, either from wall to wall and over the length (in the case of a square or rectangular shaped reactor), or from wall to centerline and over the length (in the case of a tubular or conical shaped reactor). Also, by selectively combining specific catalyst type and activity, controlled by preparation and catalyst material choices, in combination with the metal foil configuration, controlled by the aperture and aperture shape choices, desired mass and heat transport properties are then matched, associated with the particular reactions to be controlled in a given process reactor.

A catalyst bed prepared by the method of the invention exhibits additional properties throughout the reactor. These additional properties include: selectivity of the catalyst for reaction rate control and subsequent control of temperature, selectivity of the catalyst to control production of intermediate chemical species which inhibit carbon formation, and distribution of reacting species in the gas phase to create a more uniform temperature profile under all conditions.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 5 is a section view taken along section IV-IV of FIG. 4;

FIG. 6 is a perspective view of the exemplary herringbone pattern foil of FIG. 4;

FIG. 7 is a plan view of a rectangular, layered catalytic bed of the present invention.

DETAILED DESCRIPTION OF THE PREFERRED EMBODIMENTS

The following description of the preferred embodiment(s) is merely exemplary in nature and is in no way intended to limit the invention, its application, or uses. Variations that do not depart from the jist of the invention are intended to be within the scope of the invention. Such variations are not to be regarded as a departure from the spirit and scope of the invention.

Figure 1A:
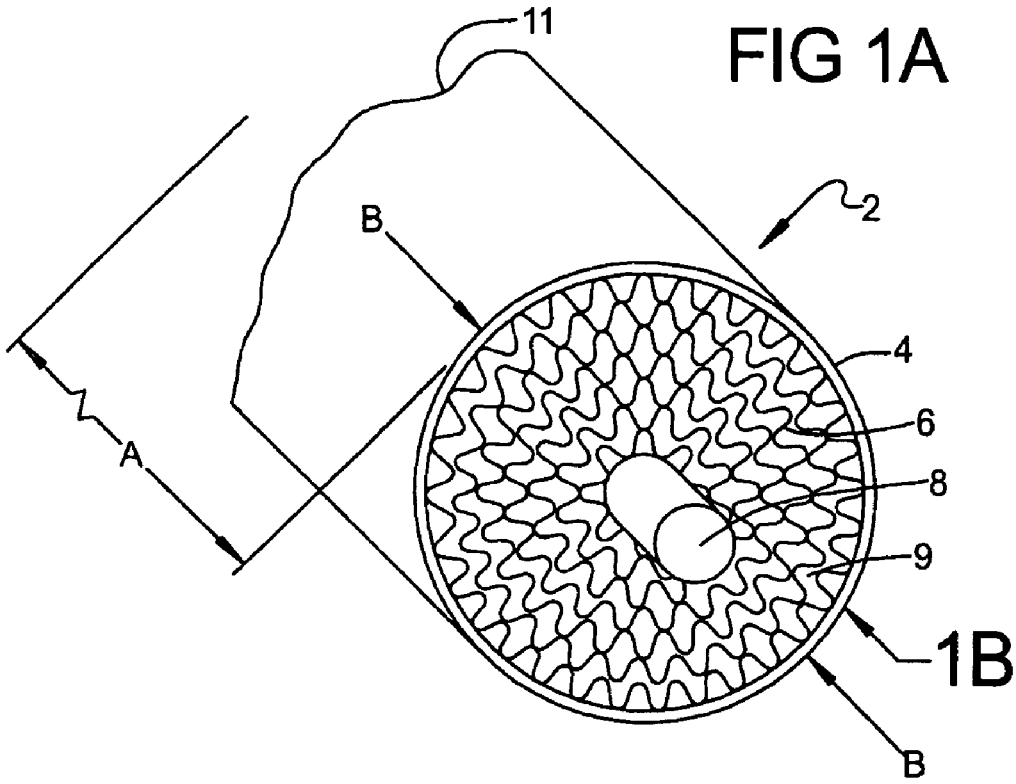
FIG. 1A is a perspective view of an exemplary rolled coil configuration of a preferred embodiment of the present invention.
Figure 1B:
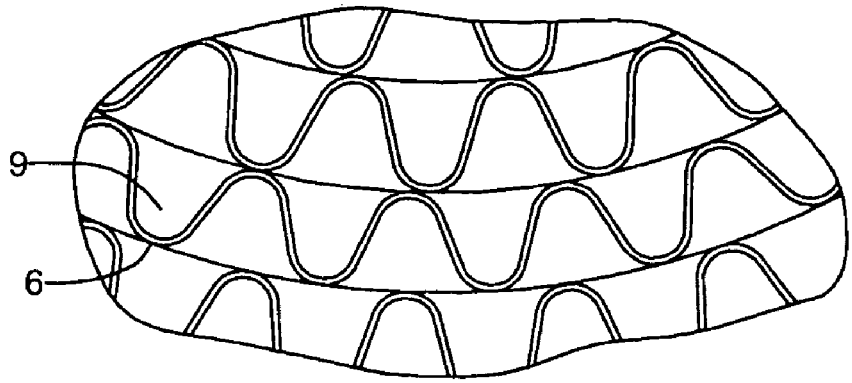
FIG. 1B is an exploded view of an end of the rolled coil of FIG. 1.

Referring to FIG. 1A, a catalytic reactor assembly 2 of the present invention is disclosed. Catalytic reactor assembly 2 includes an outer body 4, a catalytic bed having a series of metal foil layers 6, and a central mandrel 8. In this configuration, a catalytic bed length A and a catalytic bed diameter B are represented. Flow through the metal foil layer 6, will enter through an inlet end 9 of catalytic reactor assembly 2 and travel through the paths of the metal foil layers 6 to an exit end 11 of catalytic reactor assembly 2. Referring now to FIG. 1B an exploded view of inlet end 9 of the rolled coil of FIG. 1 is shown. FIG. 1B shows that a multitude of metal foil layers 6 are stacked as they are rolled such that there is no "nesting" between individual layers of the bed.

Figure 2:
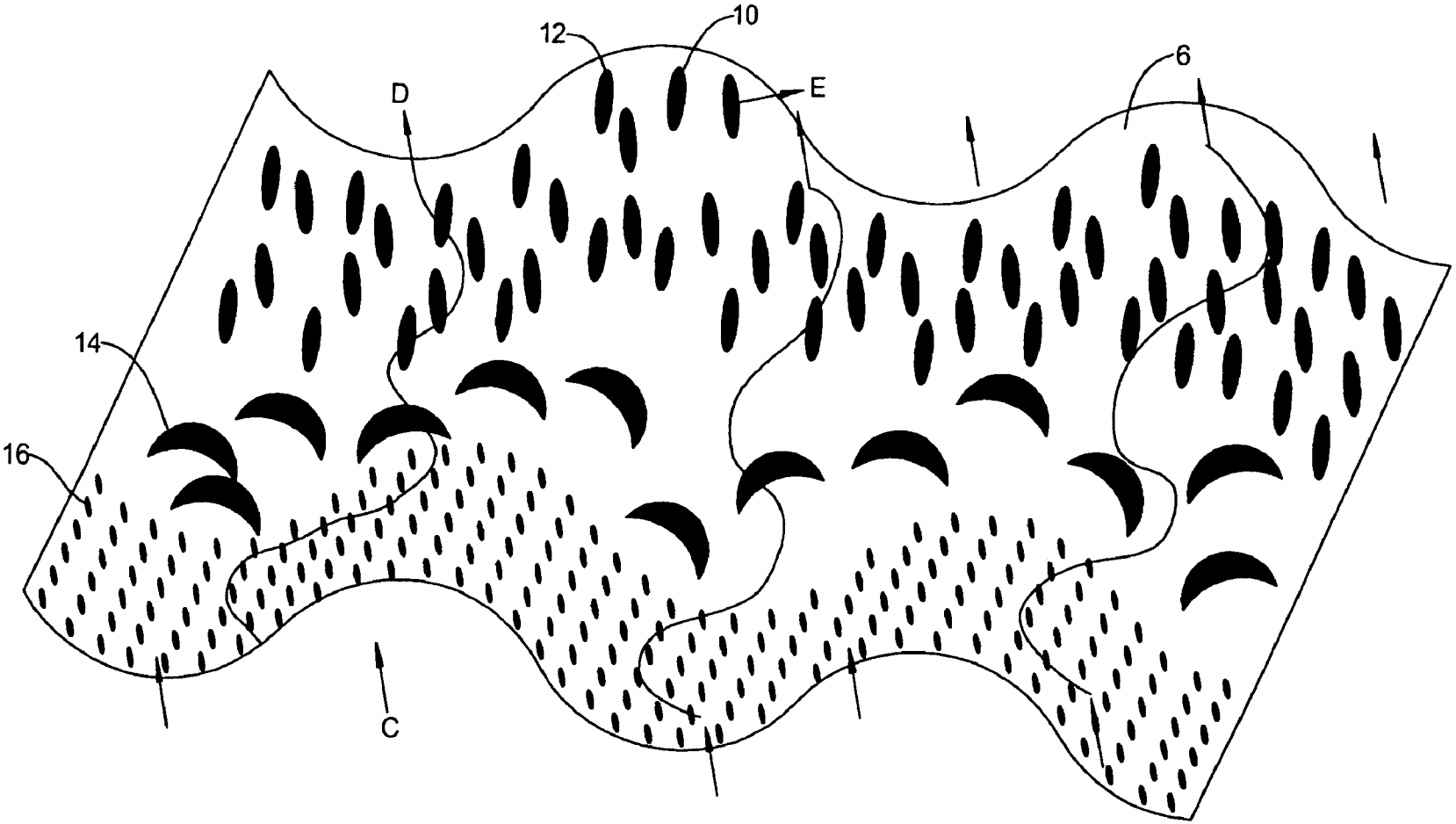
FIG. 2 is a perspective view of a single metal foil layer of the present invention showing exemplary aperture patterns.

Referring now to FIG. 2, an individual metal foil layer 6 of the present invention is shown. Initially, individual metal foil layer 6 is selected in width and length to suit the application or geometry of the given catalytic bed. Each metal foil layer 6 of the catalytic bed will be initially perforated with a plurality of apertures 10 having one or more individual shapes, sizes, or series pattern. FIG. 2 identifies three exemplary individual aperture 10 shapes and sizes. Disclosed are oval apertures 12, crescent apertures 14, and circular apertures 16. The sizes, the locations, and the spacings of the various apertures 10 can be varied from individual application to application. Selection of the location type and size of the individual apertures 10 may also be selected such that longitudinal flow along the individual channels of the metal foil layer 6 can be effected by the placement, shape, and opening size of the individual apertures 10.

FIG. 2 also shows flow direction C. Based on the pattern of the metal foil layer 6 in addition to number and spacing of apertures 10, flow direction C will change along the length A of the metal foil layer 6. This is evident from channel flow direction D which indicates how flow may vary down the length of the metal foil layer 6. The shape or channel geometry of metal foil layer 6 herein is shown as wave patterns. Flow in channel flow direction D is effected by flow from aperture flow direction E. Flow in aperture flow direction E results from flow between individual layers of the catalytic bed assembly. It is the combination of flow along the channeled pattern and through the aperture flow direction E that creates turbulent flow throughout the catalytic bed.

Figure 3:
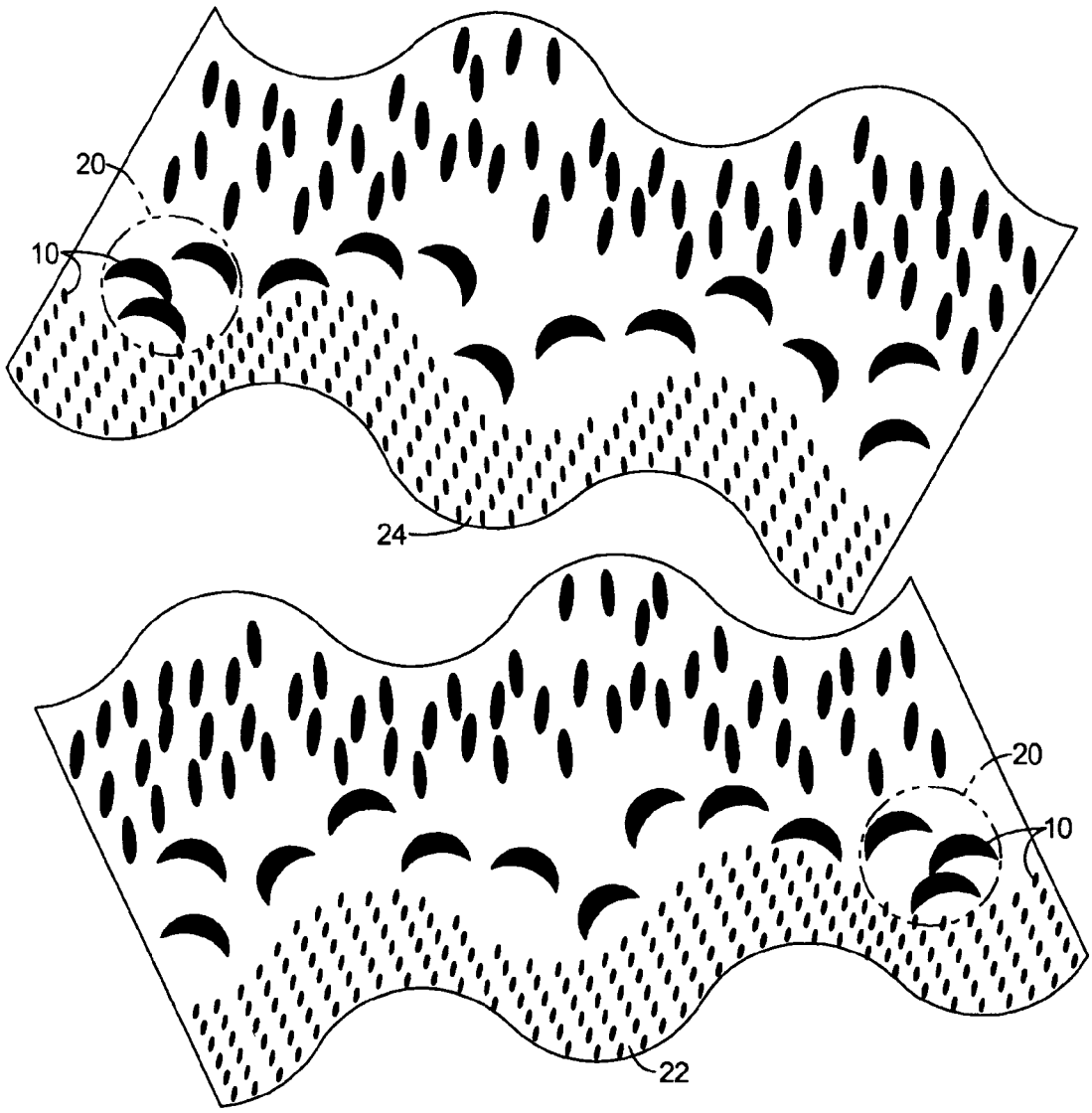
FIG. 3 is a perspective view of two layers of metal foil having opposed aperture patterns, prior to assembly.

FIG. 3 is a perspective view of two individual metal foil layers each having the same aperture pattern but the sheets reversed. The reversed sheet aperture pattern is evident from the locations of aperture group 20 between the lower foil layer 22 and the upper foil layer 24. In this version, the individual metal foil layers are positioned such that flow between individual layers through the apertures is forced to change direction and is not permitted to channel through commonly aligned apertures 10. This promotes turbulent flow throughout individual layers of the catalytic bed.

Figure 4:
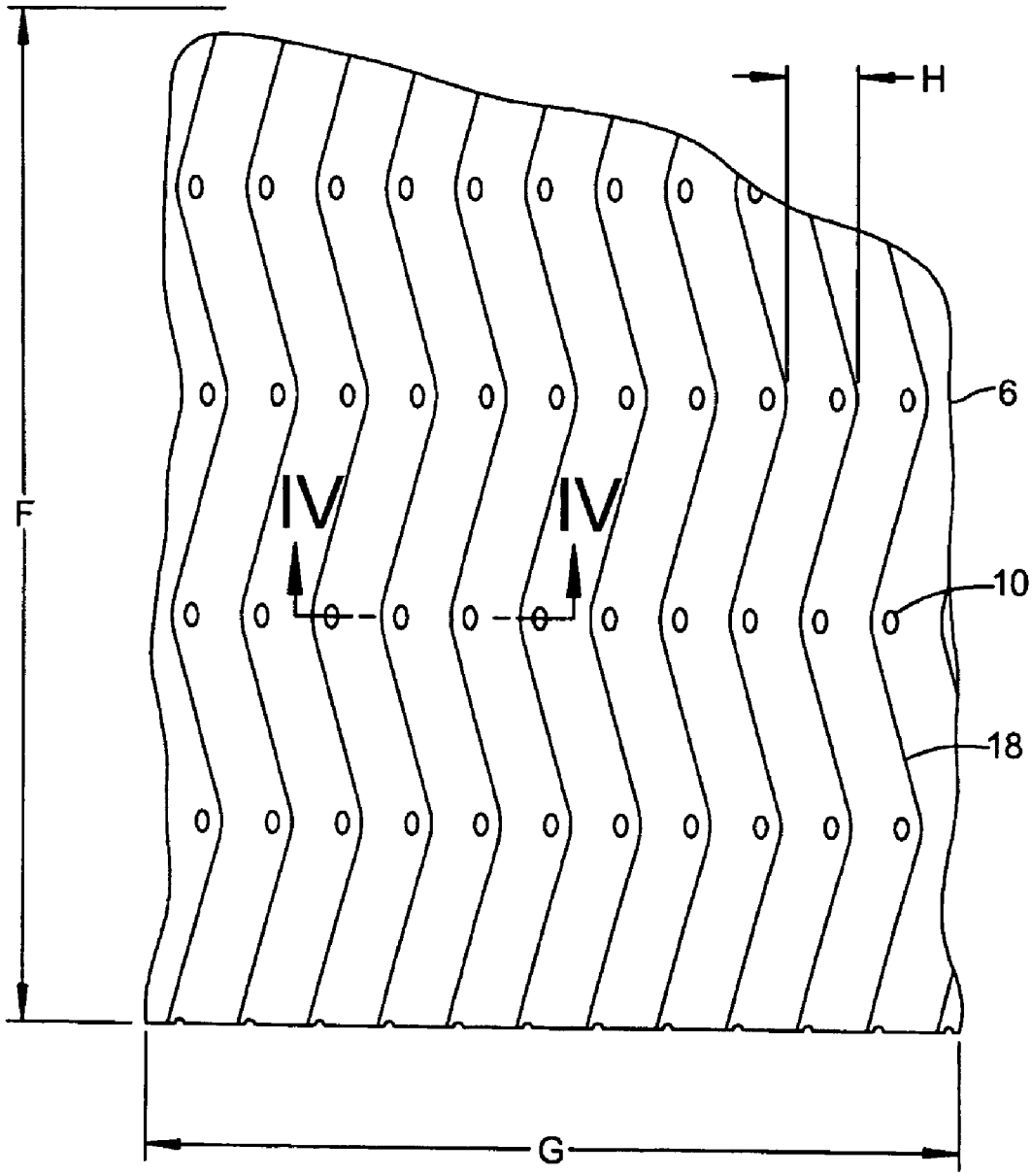
FIG. 4 is a plan view of an exemplary herringbone pattern of a single metal foil layer of the present invention.

Referring to FIG. 4, an exemplary herringbone patterned metal foil layer 6 is disclosed. FIG. 4 represents a plan view of an individual layer of metal foil layer 6. The herringbone pattern shown is rolled or formed into an individual metal foil layer 6 following perforation of the apertures 10 through metal foil layer 6. Apertures 10 may also be formed at the same time as the channel geometry or after channel geometry formation, depending on the forming process desired. The pattern formed on the metal foil layer 6 repeats itself such that flow along the foil pattern width F will be forced to change direction several times along the width F. Foil pattern length G is selected based on the geometry chosen for the catalytic bed. The number of individual pattern lines 18 may also be varied depending upon the geometry of the catalytic bed. FIG. 4 shows individual rows of apertures 10, however, any pattern size or geometry of apertures 10 may be incorporated in this invention. The foil pattern offset H may also be varied to create as many flow changes of direction as desired.

FIG. 5 is a section view taken along Section IV-IV of FIG. 4. FIG. 4 provides foil pattern pitch J, foil pattern depth K, and foil thickness L. An exemplary pattern pitch J of 1.52 mm, pattern depth K of 1.02 mm and foil thickness L of 0.08 mm are shown.

FIG. 6 is a perspective view of the exemplary herringboned pattern foil of FIG. 3. An individual metal foil layer 6 is provided in FIG. 5 having general flow direction M.

Referring now to FIG. 7, a perspective view of a rectangular, layered catalytic bed of the present invention is shown. In this version individual metal foil layers 6 are stacked and enclosed within catalytic body 26. Catalytic body 26 height N and width O are preselected to form a variety of shapes ranging from square to rectangular. Corners of catalytic body 26 can be rounded.

Figure 8:
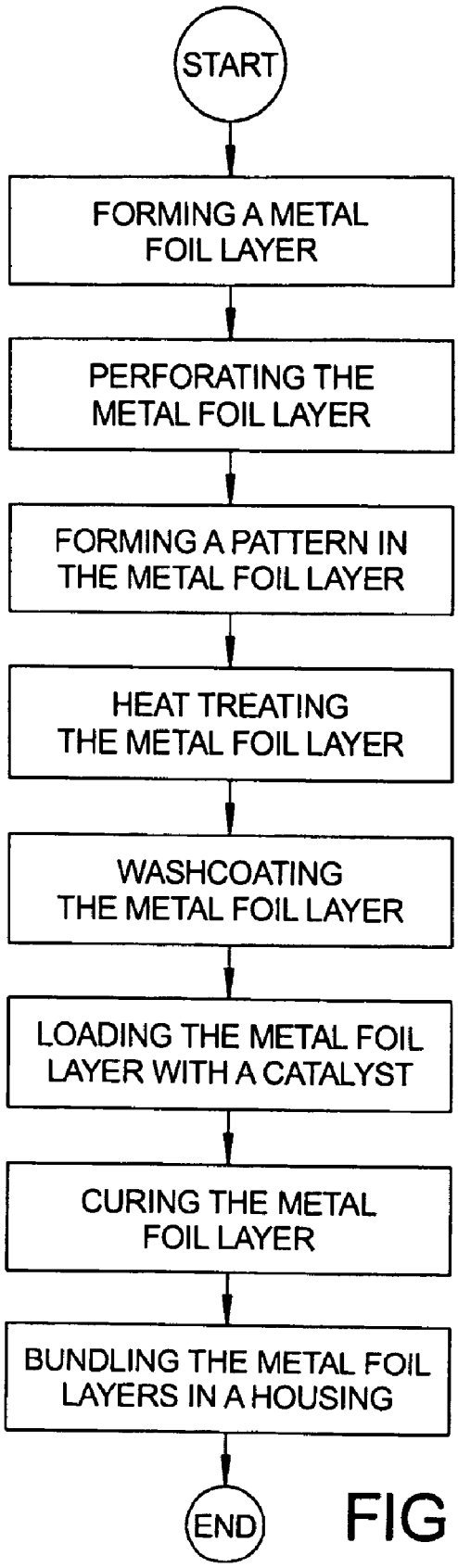
FIG. 8 is a flow chart schematically illustrating a method of manufacturing a fuel cell processor in accordance with the present invention.

With reference now to FIG. 8, a preferred method of assembly for a catalytic bed of the present invention includes the following steps: (1) a metal foil layer 6 having the appropriate thickness, length and width dimensions is formed; (2) the metal foil layer 6 is perforated with the quantity, size, and location of apertures 10 as required for the configuration; (3) a pattern is formed into the perforated metal foil; (4) the patterned and perforated metal foil is heat treated to prepare it for a wash coat; (5) a washcoat is applied following the heat treatment; (6) the washcoated material has a catalytic layer applied over it; (7) the layered foil is cured; and (8) one or more layers of foil are formed into the geometric pattern required. Optionally, the washcoat may be applied in several layers step (5) and the curing process of step (7) may be performed either before or after assembly into the bed configuration. In a modification of the preferred method of assembly, the washcoat and catalytic layer are applied together in the same solution and may be built-up over several layers.

The preferred method of assembly lends itself to fabricating a graded or multi-catalyst bed. In this regard, different amounts of catalyst may be applied on a single sheet in step (6) or different catalyst materials may be applied on different individual metal foil sheets which are formed into the desired geometric pattern in step (8).

Referring back to FIG. 1, a circular or wound catalyst bed is formed by performing the following steps: (1) a central mandrel is provided; (2) an end of at least one length of foil is welded or fixed to a first end of the mandrel 8; (3) the mandrel is spun or the foil is wrapped to provide concentric layers of the foil around the mandrel; (4) a preselected number of layers are applied to provide a desired diameter of the catalytic bed; and (5) the outer cylinder of the bed is disposed around the wound catalytic layers. Alternatively, to preclude a telescoping effect of the layers as the foil is wound about the mandrel 8, two individual foil layers may be started; one at a first end of the mandrel and a second at a second end of the mandrel with each foil layer attached to the mandrel. The individual layers are counter-wound (i.e., wrapped in opposite directions) about the mandrel. This precludes a telescoping effect which could restrict flow through the resulting catalytic bed.

The present invention has the benefit over the conventional honeycombed design of providing 3-dimensional flow capability. For example, in the cylindrical embodiment shown in FIG. 1, reactants can flow axially, radially and circumferentially with reactor assembly 2, In addition, the present invention provides: (1) individual flow channels through the length of the catalytic bed; (2) a metallic support structure which provides individual washcoat and catalytic material placement; (3) the ability to prefabricate and apply the washcoat and catalyst before assembly of the structure in direct contrast to the honeycomb method which requires that the honeycomb be washcoated and catalyzed after assembly; and (4) the apertures provided in each layer of the metal foil provide radial and circumferential bed flow. Also, by selectively controlling the location and size of the apertures, it is possible to provide smaller apertures at the inlet end of the catalytic bed and larger apertures progressively along the length of the catalytic bed. This configuration provides good mixing at both ends of the catalytic bed due to pressure drop balancing along the bed length.

The present invention utilizes conventional washcoats known in the art and may comprise an alumina material washcoated to a desired thickness on the metal support structure. Normally the catalyst is added after the washcoat, however, with this invention the catalyst may be added together with the washcoat and applied in one or more layers on each metal foil layer. Exemplary catalyst loading is a very low percentage of the washcoat loading. Particle size of the catalyst is in the nanometer range.

The method described herein is not limited to specific uses of catalytic reactors. Various catalytic uses may be applicable. Exemplary uses include, but are not limited to reactors for partial oxidation, steam reforming, and water/gas shift. Further uses include catalytic converters, ammonia synthesis requiring controlled gradients within the bed, preferential oxidation reactors and combustors.

Since each foil sheet or segment is individually formed, washcoated and catalyzed, this method also permits the use of different catalyst materials and/or loadings throughout the reactor and the potential to provide gradation of one or more catalysts throughout the reactor which provides the added benefit of minimizing costly catalyst material used.

Disclosed is a method for assembling catalyst beds that incorporates the use of multiple design configurations of the catalyst support and the methods for applying catalysts as a result of this assembly process. Application of this process of using any of several different catalyst support configurations provides a more flexible and versatile method for producing fuel cell fuel processor catalytic reactors. These catalyst beds may exhibit higher activity in smaller volumes because of improved heat and mass transfer, reduced precious metal loading, improved cost, improved passive control, and increased turndown capability in comparison to conventional packed beds, foam support or honeycomb monolith beds. Flexibility in reactor design is also provided, as a result of the variability possible to tailor changes in the flowfield, catalyst loading and catalyst type throughout the reactor volume to match reaction conditions and demands.

What is claimed is:

1. A method to manufacture a catalytic bed for an vehicle fuel processor comprising the steps of:

providing a metal foil having a desired aperture pattern and a plurality of both aperture shapes and sizes;

shaping the metal foil to form a repeating pattern;

heat-treating the patterned foil in preparation for at least one washcoat;

coating the heat-treated foil pattern with at least one washcoat;

applying at least one catalyst over a preselected area of the coated foil pattern to form a graded catalyst formation;

forming a geometric shape from at least two layers of the coated foil pattern to form the catalytic bed; and positioning a first layer of the catalytic bed and a second layer of the catalytic bed at a corresponding position to preclude overlapping the aperture pattern.

2. The method of claim 1 comprising the further steps of:

rolling the coated foil pattern around a mandrel;

welding an end of the rolled coil to the mandrel; and coiling the rolled coil about the mandrel to form the geometric shape.

3. The method of claim 2, further comprising the step of disposing the geometric shape within an outer cylinder.

4. The method of claim 2, comprising the further steps of:

forming the rolled coil as a first coil and a second coil;

attaching a first end of the first coil to a first end of the mandrel;

connecting a first end of the second coil to a second end of the mandrel; and counter-coiling the first coil and the second coil about the mandrel.

5. The method of claim 1, further comprising the step of forming the geometric shape from the coated foil pattern as a stacked set of plates.

6. The method of claim 5, further comprising the step of disposing the geometric shape within an outer housing, said housing having a generally rectangular shape.

7. The method of claim 1, comprising the further steps of:

forming the geometric shape having an inlet end and an outlet end; and progressively increasing an aperture size in the aperture pattern in a direction from the geometric shape inlet end to the outlet end.

8. The method of claim 1, further comprising the step of providing a plurality of catalyst materials for the at least one catalyst coating.

9. The method of claim 8, further comprising the step of disposing the plurality of catalyst materials in a predetermined pattern within the geometric shape.

10. The method of claim 1, further comprising the step of shaping the metal foil to form a non-repeating pattern.

* * * * *